US011056130B2

(12) United States Patent
Zhu et al.

(10) Patent No.: US 11,056,130 B2
(45) Date of Patent: Jul. 6, 2021

(54) SPEECH ENHANCEMENT METHOD AND APPARATUS, DEVICE AND STORAGE MEDIUM

(71) Applicant: SHENZHEN GOODIX TECHNOLOGY CO., LTD., Shenzhen (CN)

(72) Inventors: Hu Zhu, Shenzhen (CN); Xinshan Wang, Shenzhen (CN); Guoliang Li, Shenzhen (CN); Duan Zeng, Shenzhen (CN); Hongjing Guo, Shenzhen (CN)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 35 days.

(21) Appl. No.: 16/661,935

(22) Filed: Oct. 23, 2019

(65) Prior Publication Data

US 2020/0265857 A1 Aug. 20, 2020

(30) Foreign Application Priority Data

Feb. 15, 2019 (CN) ..... 201910117712.4

(51) Int. Cl.
*G10L 21/0232* (2013.01)
*G10L 21/0364* (2013.01)

(52) U.S. Cl.
CPC ..... *G10L 21/0232* (2013.01); *G10L 21/0364* (2013.01)

(58) Field of Classification Search
None
See application file for complete search history.

(56) References Cited

U.S. PATENT DOCUMENTS

2009/0164212 A1 6/2009 Chan
2013/0046535 A1* 2/2013 Parikh ..... G10L 21/0208 704/226
2018/0277135 A1 9/2018 Ali

FOREIGN PATENT DOCUMENTS

CN 101685638 A 3/2010
CN 101807404 A 8/2010
(Continued)

OTHER PUBLICATIONS

First Office Action of the prior Chinese application.
(Continued)

*Primary Examiner* — Richa Mishra
(74) *Attorney, Agent, or Firm* — J.C. Patents

(57) ABSTRACT

The present disclosure provides a speech enhancement method and apparatus, a device and a storage medium. The method includes: acquiring a first speech signal and a second speech signal; obtaining a signal to noise ratio of the first speech signal; determining, according to the signal to noise ratio of the first speech signal, a fusion coefficient of filtered signals corresponding to the first speech signal and the second speech signal; and performing, according to the fusion coefficient, speech fusion processing on the filtered signals corresponding to the first speech signal and the second speech signal to obtain an enhanced speech signal. Thereby, it is realized that a fusion coefficient of speech signals of a non-air conduction speech sensor and an air conduction speech sensor is adaptively adjusted according to environment noise, thereby improving the signal quality after speech fusion, and improving the effect of speech enhancement.

16 Claims, 7 Drawing Sheets

(56) References Cited

FOREIGN PATENT DOCUMENTS

| | | | | |
|---|---|---|---|---|
| CN | 102347027 | A | * | 2/2012 |
| CN | 102347027 | A | | 2/2012 |
| CN | 105632512 | A | * | 6/2016 |
| CN | 105632512 | A | | 6/2016 |
| CN | 109102822 | A | | 12/2018 |
| EP | 2458586 | A1 | | 5/2012 |
| WO | WO2017190219 | A1 | | 11/2017 |

OTHER PUBLICATIONS

"Research on Digital Hearing Aid Speech Enhancement Algorithm", Proceedings of the 37th Chinese Control Conference, Jul. 25-27, 2018, Wuhan, China.
"Speech enhancement based on harmonic reconstruction filter used in digital hearing aids", Chinese Journal of Electron Devic, vol. 41 No. 6 Dec. 2018.
First Office Action of parallel EPO application No. 19204922.9.
XP 2311265A.
XP 11531021A IEEE Transactions on Audio, Speech, and Language Processing, vol. 21, No. 12, Dec. 2013.

* cited by examiner

SPEECH ENHANCEMENT METHOD AND APPARATUS, DEVICE AND STORAGE MEDIUM

CROSS-REFERENCE TO RELATED APPLICATIONS

The present application claims priority to Chinese application No. 201910117712.4, filed on Feb. 15, 2019, which is incorporated by reference in its entirety.

TECHNICAL FIELD

The present application relates to the field of speech processing technology, and in particular, to a speech enhancement method and apparatus, a device and a storage medium.

BACKGROUND

Speech enhancement is an important part of speech signal processing. By enhancing speech signals, the clarity, intelligibility and comfort of the speech in a noisy environment can be improved, thereby improving the human auditory perception effect. In a speech processing system, before processing various speech signals, it is often necessary to perform speech enhancement processing first, thereby reducing the influence of noise on the speech processing system.

At present, the combination of a non-air conduction speech sensor and an air conduction speech sensor is generally used to improve speech quality. A voiced/unvoiced segment is determined according to the non-air conduction speech sensor and the determined voiced segment is applied to the air conduction speech sensor to extract the speech signals therein.

However, high frequency speech signals of the non-air conduction speech sensor are easily interfered by high frequency noise, resulting in a serious loss of the speech signals in the high frequency part, thereby affecting the quality of the output speech signals.

SUMMARY

The present disclosure provides a speech enhancement method and apparatus, a device and a storage medium, which can adaptively adjust a fusion coefficient of speech signals of a non-air conduction speech sensor and an air conduction speech sensor according to environment noise, thereby improving the signal quality after speech fusion, and improving the effect of speech enhancement.

In a first aspect, an embodiment of the present disclosure provides a speech enhancement method, including:

acquiring a first speech signal and a second speech signal;

obtaining a signal to noise ratio of the first speech signal;

determining, according to the signal to noise ratio of the first speech signal, a fusion coefficient of filtered signals corresponding to the first speech signal and the second speech signal; and performing, according to the fusion coefficient, speech fusion processing on the filtered signals corresponding to the first speech signal and the second speech signal to obtain an enhanced speech signal.

Optionally, acquiring a first speech signal and a second speech signal includes:

acquiring the first speech signal through an air conduction speech sensor, and acquiring a second speech signal through a non-air conduction speech sensor; where the non-air conduction speech sensor includes a bone conduction speech sensor, and the air conduction speech sensor includes a microphone.

Optionally, obtaining a signal to noise ratio of the first speech signal includes:

preprocessing the first speech signal to obtain a preprocessed signal;

performing Fourier transform processing on the preprocessed signal to obtain a corresponding frequency domain signal; and estimating a noise power of the frequency domain signal, and obtaining the signal to noise ratio of the first speech signal based on the noise power.

Optionally, after obtaining a signal to noise ratio of the first speech signal, the method further includes:

determining, according to the signal to noise ratio of the first speech signal, a cutoff frequency of a first filter corresponding to the first speech signal, and a cutoff frequency of a second filter corresponding to the second speech signal; and performing filtering processing on the first speech signal through the first filter to obtain a first filtered signal, and performing filtering processing on the second speech signal through the second filter to obtain a second filtered signal.

Optionally, determining, according to the signal to noise ratio of the first speech signal, a cutoff frequency of a first filter corresponding to the first speech signal, and a cutoff frequency of a second filter corresponding to the second speech signal includes:

obtaining a priori signal to noise ratio of each frame of speech of the first speech signal;

determining, in a preset frequency range, a number of frequency points at which the priori signal to noise ratio continuously increases; and calculating and obtaining the cutoff frequencies of the first filter and the second filter according to the number of frequency points, a sampling frequency of the first speech signal, and a number of sampling points of the Fourier transform.

Optionally, determining, according to the signal to noise ratio of the first speech signal, a fusion coefficient of filtered signals corresponding to the first speech signal and the second speech signal includes:

constructing a solution model of the fusion coefficient, where the solution model of the fusion coefficient is as follows:

$$k_\lambda=\gamma k_{\lambda-1}+(1-\gamma)f(SNR),$$

where: $f(SNR)=0.5\cdot\tanh(0.025\cdot SNR)+0.5$, $$k_\lambda=\max[0,f(SNR)] \text{ or } k_\lambda=\min[f(SNR),1],$$

where: $k_\lambda$ is the fusion coefficient of a $\lambda^{th}$ frame of speech signal, $\gamma$ is a smoothing factor of the fusion coefficient, $k_{\lambda-1}$ is the fusion coefficient of a $(\lambda-1)^{th}$ frame of speech signal, and f(SNR) is a mapping function between a given signal to noise ratio SNR and the fusion coefficient $k_\lambda$.

Optionally, performing, according to the fusion coefficient, speech fusion processing on the filtered signals corresponding to the first speech signal and the second speech signal to obtain an enhanced speech signal includes:

performing speech fusion processing on the filtered signals corresponding to the first speech signal and the second speech signal by using a preset speech fusion algorithm; where a calculation formula of the preset speech fusion algorithm is as follows:

$$s=s_{bc}+k\cdot s_{ac},$$

where: s is the enhanced speech signal after the speech fusion, $s_{ac}$ is the filtered signal corresponding to the first speech signal, $s_{bc}$ is the filtered signal corresponding to the second speech signal, and k is the fusion coefficient.

In a second aspect, an embodiment of the present disclosure provides a speech enhancement apparatus, including:

an acquiring module, configured to acquire a first speech signal and a second speech signal;

an obtaining module, configured to obtain a signal to noise ratio of the first speech signal;

a determining module, configured to determine, according to the signal to noise ratio of the first speech signal, a fusion coefficient of filtered signals corresponding to the first speech signal and the second speech signal; and a fusion module, configured to perform, according to the fusion coefficient, speech fusion processing on the filtered signals corresponding to the first speech signal and the second speech signal to obtain an enhanced speech signal.

Optionally, the acquiring module is specifically configured to:

acquire the first speech signal through an air conduction speech sensor, and acquiring the second speech signal through a non-air conduction speech sensor; where the non-air conduction speech sensor includes a bone conduction speech sensor, and the air conduction speech sensor includes a microphone.

Optionally, the obtaining module is specifically configured to:

preprocess the first speech signal to obtain a preprocessed signal;

perform Fourier transform processing on the preprocessed signal to obtain a corresponding frequency domain signal; and estimate a noise power of the frequency domain signal, and obtaining the signal to noise ratio of the first speech signal based on the noise power.

Optionally, the apparatus further includes:

a filtering module, configured to determine, according to the signal to noise ratio of the first speech signal, a cutoff frequency of a first filter corresponding to the first speech signal, and a cutoff frequency of a second filter corresponding to the second speech signal; and perform filtering processing on the first speech signal through the first filter to obtain a first filtered signal, and performing filtering processing on the second speech signal through the second filter to obtain a second filtered signal.

Optionally, the filtering module is specifically configured to:

obtain a priori signal to noise ratio of each frame of speech of the first speech signal;

determine, in a preset frequency range, a number of frequency points at which the priori signal to noise ratio continuously increases; and calculate and obtain the cutoff frequencies of the first filter and the second filter according to the number of frequency points, a sampling frequency of the first speech signal, and a number of sampling points of the Fourier transform.

Optionally, the determining module is specifically configured to:

construct a solution model of the fusion coefficient, where the solution model of the fusion coefficient is as follows:

$$k_\lambda=\gamma k_{\lambda-1}+(1-\gamma)f(SNR),$$

$$\text{where: } f(SNR)=0.5\cdot\tanh(0.025\cdot SNR)+0.5,$$

$$k_\lambda=\max[0,f(SNR)] \text{ or } k_\lambda=\min[f(SNR),1],$$

where: $k_\lambda$ is the fusion coefficient of a $\lambda^{th}$ frame of speech signal, $\gamma$ is a smoothing factor of the fusion coefficient, $k_{\lambda-1}$ is the fusion coefficient of a $(\lambda-1)^{th}$ frame of speech signal, and f(SNR) is a mapping function between a given signal to noise ratio SNR and the fusion coefficient $k_\lambda$.

Optionally, the fusion module is specifically configured to:

perform speech fusion processing on the filtered signals corresponding to the first speech signal and the second speech signal by using a preset speech fusion algorithm; where a calculation formula of the preset speech fusion algorithm is as follows:

$$s=s_{bc}+k\cdot s_{ac},$$

where: s is the enhanced speech signal after the speech fusion, $s_{ac}$ is the filtered signal corresponding to the first speech signal, $s_{bc}$ is the filtered signal corresponding to the second speech signal, and k is the fusion coefficient.

In a third aspect, an embodiment of the present disclosure provides a speech enhancement device, including: a signal processor and a memory; where the memory has an algorithm program stored therein, and the signal processor is configured to call the algorithm program in the memory to perform the speech enhancement method of any one of the items in the first aspect.

In a fourth aspect, an embodiment of the present disclosure provides a computer readable storage medium, including: program instructions, which, when running on a computer, cause the computer to execute the program instructions to implement the speech enhancement method of any one of the items in the first aspect.

The speech enhancement method and apparatus, the device and the storage medium provided by the present disclosure acquires a first speech signal and a second speech signal; obtains a signal to noise ratio of the first speech signal; determines, according to the signal to noise ratio of the first speech signal, a fusion coefficient of filtered signals corresponding to the first speech signal and the second speech signal; and performs, according to the fusion coefficient, speech fusion processing on the filtered signals corresponding to the first speech signal and the second speech signal to obtain an enhanced speech signal. Thereby, it is realized that a fusion coefficient of speech signals of a non-air conduction speech sensor and an air conduction speech sensor is adjusted adaptively according to environment noise, thereby improving the signal quality after speech fusion, and improving the effect of speech enhancement.

BRIEF DESCRIPTION OF THE DRAWINGS

In order to illustrate the embodiments of the present disclosure or the technical solutions in the prior art more clearly, the drawings required in the description of the embodiments or the prior art will be briefly described below. Obviously, the drawings in the following description are only some embodiments of the present disclosure, and other drawings can be obtained according to these drawings by those skilled in the art without inventive efforts.

Figure 1:
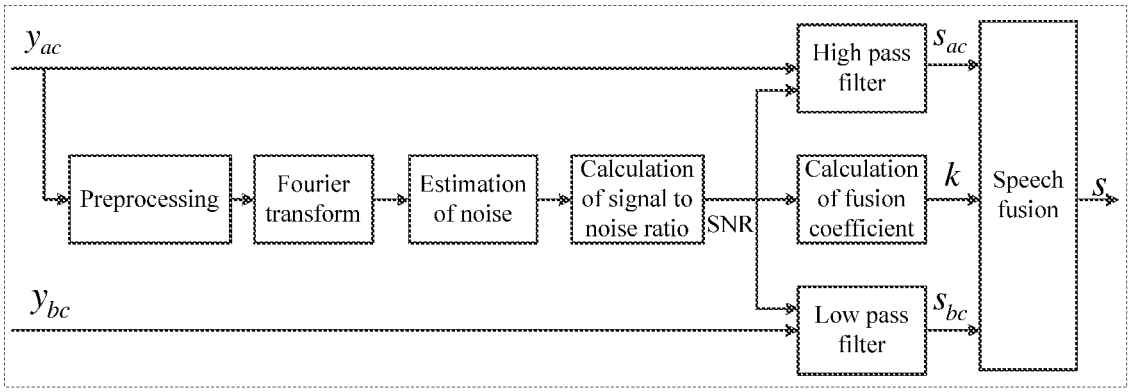
FIG. 1 is a schematic diagram of the principle of an application scenario of the present disclosure.

Through the above drawings, specific embodiments of the present disclosure have been shown, which will be described in more detail later. The drawings and the text descriptions are not intended to limit the scope of the conception of the present disclosure in any way, but rather to illustrate the concepts mentioned in the present disclosure for those skilled in the art by referring to the specific embodiments.

DESCRIPTION OF EMBODIMENTS

In order to make the objectives, technical solutions, and advantages of the embodiments of the present disclosure more clearly, the technical solutions in the embodiments of the present disclosure will be clearly and completely described in the following with reference to the accompanying drawings in the embodiments of the present disclosure. It is obvious that the described embodiments are only a part of the embodiments of the present disclosure, but not all embodiments. All other embodiments obtained by those skilled in the art based on the embodiments of the present disclosure without inventive efforts are within the scope of the present disclosure.

The terms "first", "second", "third", "fourth", etc. (if present) in the description, claims and accompanying drawings described above of the present disclosure are used to distinguish similar objects and not necessarily used to describe a specific order or an order of priority. It should be understood that the data so used is interchangeable where appropriate, so that the embodiments of the present disclosure described herein can be implemented in an order other than those illustrated or described herein. In addition, the terms "comprising" and "including" and any variants thereof are intended to cover a non-exclusive inclusion. For example, a process, method, system, product, or device that includes a series of steps or units is not necessarily limited to those steps or units that are clearly listed, but may include other steps or units that are not clearly listed or inherent to such process, method, product or device.

The technical solutions of the present disclosure will be described in detail below with specific embodiments. The following specific embodiments may be combined with each other, and the same or similar concepts or processes may not be described in some embodiments.

Speech enhancement is an important part of speech signal processing. By enhancing speech signals, the clarity, intelligibility and comfort of the speech in a noisy environment can be improved, thereby improving the human auditory perception effect. In a speech processing system, before processing various speech signals, it is often necessary to perform speech enhancement processing first, thereby reducing the influence of noise on the speech processing system.

At present, the combination of a non-air conduction speech sensor and an air conduction speech sensor is generally used to improve speech quality. A voiced/unvoiced segment is determined according to the non-air conduction speech sensor and the determined voiced segment is applied to the air conduction speech sensor to extract the speech signals therein. This is to make use of the fact that when noise exists, the speech via the air conduction speech sensor has a messy and irregular spectrum, while the speech via the bone conduction sensor has a characteristic that it has complete low-frequency signal and clean spectrum, and it is not easily affected by external noise.

However, the existing traditional single-channel noise reduction's performance relies heavily on the accuracy of noise estimation. A too large noise estimate is likely to cause speech loss and residual music noise, and a too small noise estimate makes residual noise serious and affects the intelligibility of speech. An existing practice is that, according to the characteristic of bone conduction speech, the low frequency of speech of the non-air conduction sensor is used to replace the low frequency of speech of the air conduction sensor which is subject to noise interference and to superimpose with the high frequency of speech of the air conduction sensor to resynthesize a speech signal. In this practice, the high frequency of speech of the air conduction sensor is also subject to severe noise interference, and it is difficult to obtain high quality speech. In addition, the existing fusion of bone conduction speech and air conduction speech does not consider the influence of signal to noise ratio (SNR) and the fusion coefficient is fixed, and thereby it is difficult to adapt to the environment. Moreover, although the mapping between speech via the bone conduction sensor and clean speech and noisy speech via the air conduction sensor has a good effect, but the building of the model is complex, and the resource overhead of the algorithm is too large, which is not conducive to the adoption of wearable devices.

The present disclosure provides a speech enhancement method, which can adaptively adjust the fusion coefficient of the bone conduction speech and the air conduction speech according to a SNR of environment noise. This method can avoid the dependence on the noise estimation in the single channel speech enhancement, and can adapt to the change of environment noise and to the scene where the high frequency of air conduction speech is subject to severe noise interference, and can eliminate background noise and residual music noise well. The speech enhancement method provided by the present disclosure can be applied to the field of speech signal processing technology, and is applicable to products for low power speech enhancement, speech recognition, or speech interaction, which include but are not limited to earphones, hearing aids, mobile phones, wearable devices, and smart homes. etc.

In a specific implementation process, FIG. 1 is a schematic diagram of the principle of an application scenario of the present disclosure. As shown in FIG. 1, $y_{ac}$ represents a first speech signal acquired through an air conduction speech sensor, and $y_{bc}$ represents a second speech signal acquired through a non-air conduction speech sensor. The non-air conduction speech sensor includes a bone conduction speech sensor, and the air conduction speech sensor includes a microphone. Then, the first speech signal is processed to obtain a signal to noise ratio (SNR) of the first speech signal. Specifically, the first speech signal is preprocessed to obtain a preprocessed signal; Fourier transform processing is performed on the preprocessed signal to obtain a corresponding frequency domain signal; a noise power of the frequency domain signal is estimated, and the signal to noise ratio of the first speech signal is obtained based on the noise power. Then, according to the signal to noise ratio of the first speech signal, a fusion coefficient k of filtered signals corresponding to the first speech signal and the second speech signal is determined. Optionally, a cutoff frequency of a filter may be adaptively calculated according to the signal to noise ratio of the first speech signal, so that a first filtered signal $s_{ac}$ and a second filtered signal $s_{bc}$ are obtained through corresponding filters. Finally, according to the fusion coefficient k, speech fusion processing is performed on the filtered signals corresponding to the first speech signal and the second speech signal to obtain an enhanced speech signal S.

Using the above method, it is realized that a fusion coefficient of speech signals of a non-air conduction speech sensor and an air conduction speech sensor is adaptively adjusted according to environment noise, thereby improving the signal quality after speech fusion, and improving the effect of speech enhancement.

The technical solutions of the present disclosure and how the technical solutions of the present application solve the above technical problems will be described in detail below with reference to specific embodiments. The following specific embodiments may be combined with each other, and the same or similar concepts or processes may not be described in some embodiments. The embodiments of the present disclosure will be described below with reference to the accompanying drawings.

Figure 2:
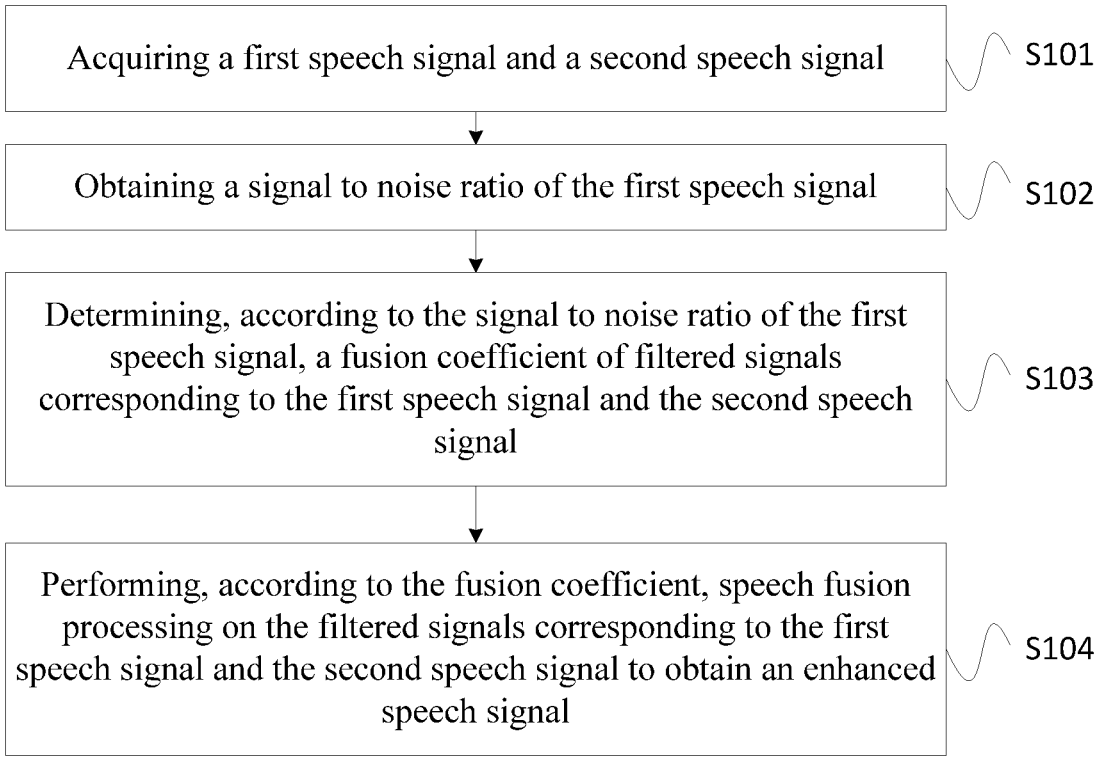
FIG. 2 is a flowchart of a speech enhancement method according to Embodiment 1 of the present disclosure.

FIG. 2 is a flowchart of a speech enhancement method according to Embodiment 1 of the present disclosure. As shown in FIG. 2, the method in the embodiment may include:

S101, acquiring a first speech signal and a second speech signal.

In the embodiment, the first speech signal is acquired through an air conduction speech sensor, and a second speech signal is acquired through a non-air conduction speech sensor; where the non-air conduction speech sensor includes a bone conduction speech sensor, and the air conduction speech sensor includes a microphone.

S102, obtaining a signal to noise ratio of the first speech signal.

In the embodiment, the first speech signal is preprocessed to obtain a preprocessed signal; Fourier transform processing is performed on the preprocessed signal to obtain a corresponding frequency domain signal; a noise power of the frequency domain signal is estimated, and the signal to noise ratio of the first speech signal is obtained based on the noise power.

Specifically, firstly, the first speech signal acquired through the air conduction speech sensor is preprocessed, mainly including pre-emphasis processing, filtering out low frequency components, enhancing high frequency speech components, and overlap windowing processing, to avoid the sudden change caused by the overlap between frames of signal. Then, through Fourier transform processing, conversion between the time domain signal and the frequency domain signal is performed to obtain the frequency domain signal of the first speech signal. Then, through the noise power estimation, an air conduction noise signal is estimated as accurately as possible; for example, the minimum value tracking method, the time recursive averaging algorithm, and the histogram-based algorithm are used for noise estimation. Finally, the signal to noise ratio of the air conduction speech signal is calculated based on the estimated noise, and the signal to noise ratio of the noisy speech signal is calculated as far as possible. There are many methods for calculating the signal to noise ratio, such as calculating the signal to noise ratio per frame, calculating a priori signal to noise ratio by decision-directed method, and the like.

In the embodiment, the sampling rate of the input data stream is Fs=8000 Hz, and the data length of data to be processed is generally between 8 ms and 30 ms. In the embodiment, the data to be processed is 64 points superimposed with 64 points of the previous frame, and then the system algorithm actually processes 128 points at a time. Firstly, the pre-emphasis processing needs to be performed on the original data to improve the high-frequency components of the speech, and there are many methods for pre-emphasis. The specific operation of the embodiment is:

$$\hat{y}_{ac}(n)=y_{ac}(n)-\alpha y_{ac}(n-1),$$

where $\alpha$ is a smoothing factor, the value of which is 0.98, $y_{ac}(n-1)$ is the air conduction speech signal at the time of n−1 before preprocessing, $y_{ac}(n)$ is the air conduction speech signal at the time of n before preprocessing, $\hat{y}_{ac}(n)$ is the air conduction speech signal at the time of n after preprocessing, and n is the $n^{th}$ moment.

The window function in the preprocessing must be a power-preserving map, that is, the sum of the squares of the windows of the overlapping portions of the speech signal must be 1, as shown below.

$$w^2(N)+w^2(N+M)=1,$$

where $w^2$ (N) is the square of the value of the window function at the $N^{th}$ point, $w^2$ (N+M) is the square of the value of the window function at the $(N+M)^{th}$ point, N is the number of points for FFT processing, the value of which in the present disclosure is 128, and the frame length M is 64. The window function design can choose a rectangular window, a Hamming window, a Hanning window, a Gaussian window function and the like according to different application scenarios, which can be flexibly selected in actual design. The embodiment adopts a Kaiser Window with a 50% overlap.

Since the noise estimation and the signal to noise ratio calculation of the present disclosure are both processed in the frequency domain, the weighted preprocessed signal is windowed, and the windowed data is transformed into the frequency domain by FFT.

$$y_w(n, m) = w(n)\hat{y}_{ac}(n, m),$$

$$Y_{ac}(m) = \sum_{n=0}^{N-1} y_w(n, m)e^{-j2\pi\frac{k}{N}n},$$

where k represents the number of spectral points, w(n) is a window function, $y_w$ (n, m) is the air conduction speech signal at the time of n after the $m^{th}$ frame speech is multiplied by the window function, and $Y_{ac}(m)$ is the spectrum of the air conduction speech signal at the frequency point m after the FFT transform.

Classical noise estimations mainly include minimum-based tracking algorithm, time recursive averaging algorithm, and histogram-based algorithm. In the embodiment the time recursive averaging algorithm (MCRA) is adopted according to actual needs, and the specific practices are as follows:

calculating smoothed noisy speech power spectral density S (λ,k), $$S(\lambda, k) = \alpha_s \cdot S(\lambda - 1, k) + (1 - \alpha_s) \cdot S_f(\lambda, k),$$

$$S_f(\lambda, k) = \sum_{-L_w}^{L_w} w(i) \cdot |Y_{ac}(\lambda, k - i)|^2,$$

where λ represents the number of frames, k represents the number of frequency points, S(λ−1,k) is the power spectral density of the $(\lambda-1)^{th}$ frame at the frequency point k, and $S_f(\lambda,k)$ is the power spectral density at the frequency point k after the frequency point of the $\lambda^{th}$ frame of air conduction speech signal is smoothed, and $Y_{ac}(\lambda,k-i)$ is the spectrum of the $\lambda^{th}$ frame of air conduction speech signal at the frequency point k−i. And $\alpha_s$ is a smoothing factor, the value of which is 0.8, w(i) is a window function, and the window function is $2L_w+1$ ($L_w=1$), and the present disclosure selects a Hamming window. The local minimum $S_{min}(\lambda,k)$ is obtained by comparing with each previous value of S(λ,k) over a fixed window length of D (D=100) frames. The probability of the existence of speech is determined from the comparison between the smoothed power spectrum S(λ,k) and a multiple of its local minimum $5 \cdot S_{min}(\lambda,k)$. When $S(\lambda,k) \geq 5 \cdot S_{min}(\lambda,k)$, p(λ,k)=1, otherwise p(λ,k)=0. Finally, the estimated noise power $\hat{\sigma}_d^2(\lambda,k)$ is obtained:

$$\hat{\sigma}_d^2(\lambda k) = \alpha_d(\lambda,k)\hat{\sigma}_d^2(\lambda-1,k) + [1-\alpha_d(\lambda,k)]|Y_{ac}(\lambda,k)|^2,$$

$$\alpha_d(\lambda,k) = \alpha + (1-\alpha)\hat{p}(\lambda,k),$$

$$\hat{p}(\lambda,k) = \alpha_p\hat{p}(\lambda-1,k) + (1-\alpha_p)p(\lambda,k),$$

where $\alpha_d(\lambda,k)$ is a smoothing coefficient of the noise at the frequency point k of the $\lambda^{th}$ frame, $\hat{\sigma}_d^2(\lambda-1,k)$ is the estimated noise power at the frequency point k of the $(\lambda-1)^{th}$ frame, $Y_{ac}(\lambda,k)$ is the spectrum of the air conduction speech signal at the frequency point k of the $\lambda^{th}$ frame, α is a smoothing constant, $\hat{p}(\lambda,k)$ is the probability of the existence of speech estimated at the frequency point k of the $\lambda^{th}$ frame, $\hat{p}(\lambda-1,k)$ is the probability of the existence of speech estimated at the frequency point k of the $\lambda-1^{th}$ frame, the smoothing factor $\alpha_p=0.2$, and the α=0.95.

The embodiment needs to calculate a priori signal to noise ratio at the frequency point k of each frame of speech ξ(λ,k) and a signal to noise ratio of the whole frame SNR(λ). The calculation of the priori signal to noise ratio at the frequency point k of each frame of speech ξ(λ,k) mainly adopts an improved decision-directing method, and the specific practices are as follows:

$$\gamma(\lambda, k) = \frac{Y^2(\lambda, k)}{\hat{\sigma}_d^2(\lambda, k)},$$

$$\hat{\xi}(\lambda, k) = \max\left[a_\xi \frac{\hat{X}^2(\lambda - 1, k)}{\hat{\sigma}_d^2(\lambda - 1, k)} + (1 - a_\xi) \max\ [\gamma(\lambda, k) - 1, 0], \xi_{min}\right],$$

where γ(λ,k) is a posteriori signal to noise ratio of each frame, $\alpha_\xi$ is a smoothing factor, the value of which is 0.98, and the value of $\xi_{min}$ is −15 dB; ξ(λ,k) is a priori signal to noise ratio at the frequency point k of the $\lambda^{th}$ frame, $\hat{X}^2(\lambda-1,k)$ is pure speech signal spectrum calculated at the frequency point k of the $\lambda-1^{th}$ frame.

The calculation formula of signal to the noise ratio of the whole frame SNR(λ) is as follows:

$$SNR(\lambda) = 10\log10\frac{\sum_{k=1}^{N}\left|Y_{ac}(\lambda, k) - \sqrt{\hat{\sigma}_d^2(\lambda, k)}\right|^2}{\sum_{k=1}^{N}\hat{\sigma}_d^2(\lambda, k)}.$$

S103, determining, according to the signal to noise ratio of the first speech signal, a fusion coefficient of filtered signals corresponding to the first speech signal and the second speech signal.

In the embodiment, a solution model of the fusion coefficient is constructed, and the solution model of the fusion coefficient is as follows:

$$k_\lambda = \gamma k_{\lambda-1} + (1-\gamma) f(SNR),$$

$$\text{where } f(SNR) = 0.5 \cdot \tanh(0.025 \cdot SNR) + 0.5,$$

$$k_\lambda = \max[0, f(SNR)] \text{ or } k_\lambda = \min[f(SNR), 1],$$

where $k_\lambda$ is the fusion coefficient of the speech signal of the $\lambda^{th}$ frame, γ is a smoothing factor of the fusion coefficient, $k_{\lambda-1}$ is the fusion coefficient of the speech signal of the $(\lambda-1)^{th}$ frame, and f(SNR) is a mapping function between a given signal to noise ratio SNR and the fusion coefficient $k_\lambda$. In the embodiment, the smoothing constant γ is chosen to be 0.95.

S104, performing, according to the fusion coefficient, speech fusion processing on the filtered signals corresponding to the first speech signal and the second speech signal to obtain an enhanced speech signal.

In the embodiment, speech fusion processing is performed on the filtered signals corresponding to the first speech signal and the second speech signal by using a preset speech fusion algorithm; where a calculation formula of the preset speech fusion algorithm is as follows:

$$s = s_{bc} + k \cdot s_{ac},$$

where s is the enhanced speech signal after the speech fusion, $s_{ac}$ is the filtered signal corresponding to the first speech signal, $s_{bc}$ is the filtered signal corresponding to the second speech signal, and k is the fusion coefficient.

The embodiment acquires a first speech signal and a second speech signal; obtains a signal to noise ratio of the first speech signal; determines, according to the signal to noise ratio of the first speech signal, a fusion coefficient of filtered signals corresponding to the first speech signal and the second speech signal; and performs, according to the fusion coefficient, speech fusion processing on the filtered signals corresponding to the first speech signal and the second speech signal to obtain an enhanced speech signal. Thereby, it is realized that a fusion coefficient of speech signals of a non-air conduction speech sensor and an air conduction speech sensor is adaptively adjusted according to environment noise, thereby improving the signal quality after speech fusion, and improving the effect of speech enhancement.

Figure 3:
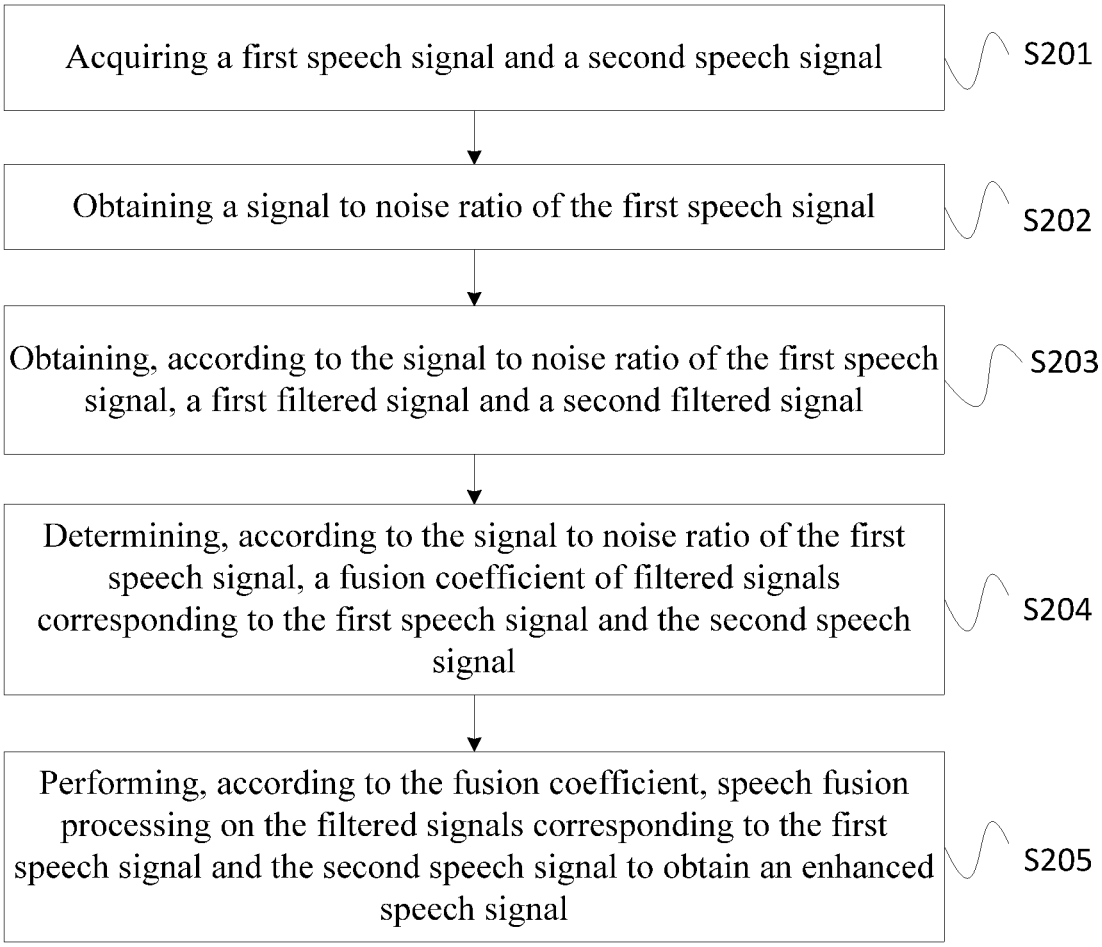
FIG. 3 is a flowchart of a speech enhancement method according to Embodiment 2 of the present disclosure.

FIG. 3 is a flowchart of a speech enhancement method according to Embodiment 2 of the present disclosure. As shown in FIG. 3, the method in the embodiment may include:

S201, acquiring a first speech signal and a second speech signal.

S202, obtaining a signal to noise ratio of the first speech signal.

For the specific implementation process and technical principles of the steps S201 to S202 in this embodiment, refer to the related descriptions in the steps S101 to S102 in the method shown in FIG. 2, and details are not described herein again.

S203, obtaining, according to the signal to noise ratio of the first speech signal, a first filtered signal and a second filtered signal.

In the embodiment, a cutoff frequency of a first filter corresponding to the first speech signal and a cutoff frequency of a second filter corresponding to the second speech signal are determined according to the signal to noise ratio of the first speech signal; filtering processing is performed on the first speech signal through the first filter to obtain a first filtered signal, and filtering processing is performed on the second speech signal through the second filter to obtain a second filtered signal.

In an alternative implementation, a priori signal to noise ratio of each frame of speech of the first speech signal is obtained; the number of frequency points at which the priori signal to noise ratio continuously increases is determined in a preset frequency range; and the cutoff frequencies of the first filter and the second filter are calculated and obtained according to the number of frequency points, a sampling frequency of the first speech signal, and a number of sampling points of Fourier transform.

Figure 4:
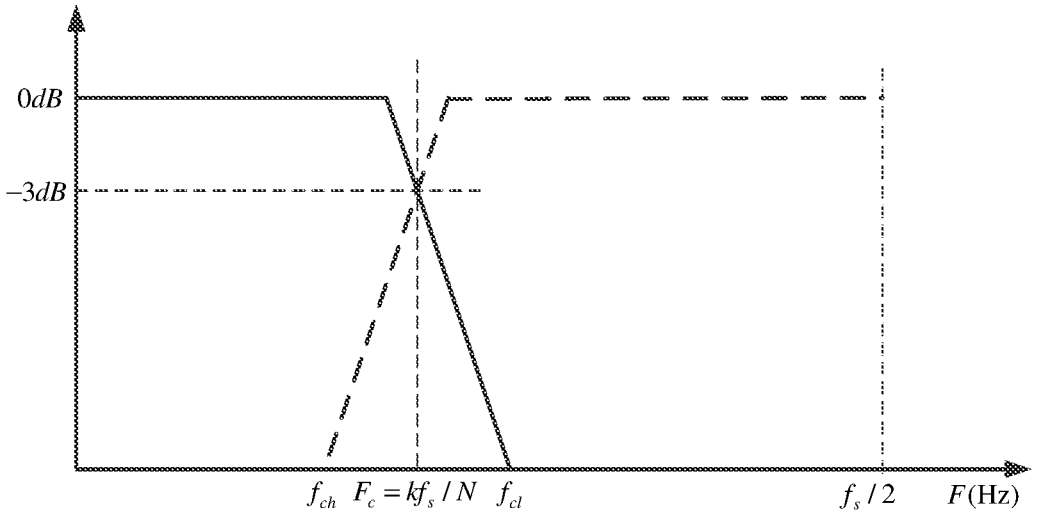
FIG. 4 is a design diagram of a high pass filter and a low pass filter according to an embodiment of the present disclosure.

Specifically, the cutoff frequencies of the high pass filter and the low pass filter are adaptively adjusted by the priori signal to noise ratio $\xi(\lambda,k)$ of each frame of speech. The specific processing flow is as follows:

First, the low frequency part $\xi(\lambda,k)=\xi(\lambda,k)\ k\leq\lceil 2000\cdot N/f_s\rceil$ of $\xi(\lambda,k)$ is selected. Then, the slope between the two points of $\xi(\lambda,k)$ is calculated. Then, the number of frequency points k at which the slope continuously increases is selected, or the number of frequency points k at which the priori signal to noise ratio continuously increases is found. FIG. 4 is a design diagram of a high pass filter and a low pass filter according to an embodiment of the present disclosure. As shown in FIG. 4, the cutoff frequencies of the high pass filter and the low pass filter are:

$$f_{cl}=\min[k\cdot f_s/N+200,2000],$$

$$f_{ch}=\max[k\cdot f_s/N-200,800],$$

where $f_{cl}$ is the cutoff frequency of the low pass filter, $f_{ch}$ is the cutoff frequency of the high pass filter, and N represents the number of points of the FFT, $f_s$ is the sampling rate, here $f_s$=8000 Hz.

S204, determining, according to the signal to noise ratio of the first speech signal, a fusion coefficient of filtered signals corresponding to the first speech signal and the second speech signal.

S205, performing, according to the fusion coefficient, speech fusion processing on the filtered signals corresponding to the first speech signal and the second speech signal to obtain an enhanced speech signal.

For the specific implementation process and technical principles of the steps S204 to S205 in the embodiment, refer to the related descriptions in the steps S103 to S104 in the method shown in FIG. 2, and details are not described herein again.

The embodiment acquires a first speech signal and a second speech signal; obtains a signal to noise ratio of the first speech signal; determines, according to the signal to noise ratio of the first speech signal, a fusion coefficient of filtered signals corresponding to the first speech signal and the second speech signal; and performs, according to the fusion coefficient, speech fusion processing on the filtered signals corresponding to the first speech signal and the second speech signal to obtain an enhanced speech signal. Thereby, it is realized that a fusion coefficient of speech signals of a non-air conduction speech sensor and an air conduction speech sensor is adaptively adjusted according to environment noise, thereby improving the signal quality after speech fusion, and improving the effect of speech enhancement.

In addition, the embodiment can further determine, according to the signal to noise ratio of the first speech signal, a cutoff frequency of a first filter corresponding to the first speech signal and a cutoff frequency of a second filter corresponding to the second speech signal; perform filtering processing on the first speech signal through the first filter to obtain a first filtered signal, and perform filtering processing on the second speech signal through the second filter to obtain a second filtered signal. Thereby the signal quality after speech fusion is improved, and the effect of speech enhancement is improved.

Figure 5:
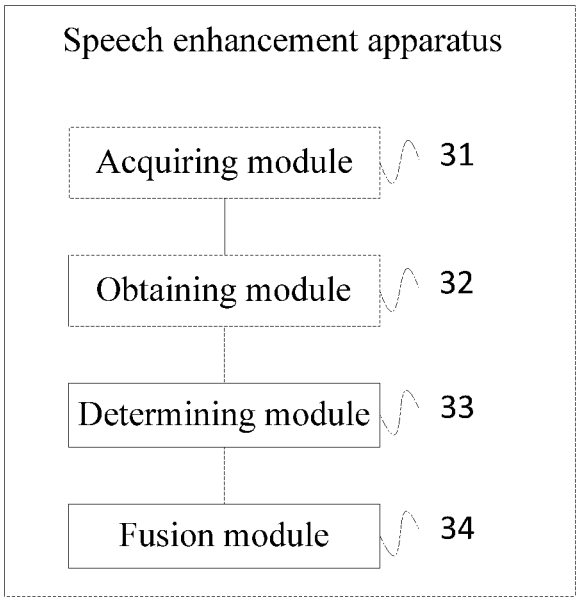
FIG. 5 is a schematic structural diagram of a speech enhancement apparatus according to Embodiment 3 of the present disclosure.

FIG. 5 is a schematic structural diagram of a speech enhancement apparatus according to Embodiment 3 of the present disclosure. As shown in FIG. 5, the speech enhancement apparatus of the embodiment may include:

- an acquiring module 31, configured to acquire a first speech signal and a second speech signal;
- an obtaining module 32, configured to obtain a signal to noise ratio of the first speech signal;
- a determining module 33, configured to determine, according to the signal to noise ratio of the first speech signal, a fusion coefficient of filtered signals corresponding to the first speech signal and the second speech signal;
- a fusion module 34, configured to perform, according to the fusion coefficient, speech fusion processing on the filtered signals corresponding to the first speech signal and the second speech signal to obtain an enhanced speech signal.

Optionally, the acquiring module 31 is specifically configured to:

- acquire the first speech signal through an air conduction speech sensor, and acquire the second speech signal through a non-air conduction speech sensor; where the non-air conduction speech sensor includes a bone conduction speech sensor, and the air conduction speech sensor includes a microphone.

Optionally, the obtaining module 32 is specifically configured to:

- preprocess the first speech signal to obtain a preprocessed signal;
- perform Fourier transform processing on the preprocessed signal to obtain a corresponding frequency domain signal;
- estimate a noise power of the frequency domain signal, and obtain the signal to noise ratio of the first speech signal based on the noise power.

Optionally, the determining module 33 is specifically configured to:

- construct a solution model of the fusion coefficient, where the solution model of the fusion coefficient is as follows:

$$k_\lambda=\gamma k_{\lambda-1}+(1-\gamma)f(SNR),$$

where $f(SNR)=0.5\cdot\tanh(0.025\cdot SNR)+0.5$, $$k_\lambda=\max[0,f(SNR)] \text{ or } k_\lambda=\min[f(SNR),1],$$

where $k_\lambda$ is the fusion coefficient of a $\lambda^{th}$ frame of speech signal, $\gamma$ is a smoothing factor of the fusion coefficient, $k_\lambda-1$ is the fusion coefficient of a $(\lambda-1)^{th}$ frame of speech signal, and f(SNR) is a mapping function between a given signal to noise ratio SNR and the fusion coefficient $k_\lambda$.

Optionally, the fusion module 34 is specifically configured to:

perform speech fusion processing on the filtered signals corresponding to the first speech signal and the second speech signal by using a preset speech fusion algorithm; where a calculation formula of the preset speech fusion algorithm is as follows:

$$s=s_{bc}+k\cdot s_{ac},$$

where s is the enhanced speech signal after the speech fusion, $s_{ac}$ is the filtered signal corresponding to the first speech signal, $s_{bc}$ is the filtered signal corresponding to the second speech signal, and k is the fusion coefficient.

The speech enhancement apparatus of the embodiment can perform the technical solution in the method shown in FIG. 2. For the specific implementation process and technical principles, refer to the related descriptions in the method shown in FIG. 2, and details are not described herein again.

The embodiment acquires a first speech signal and a second speech signal; obtains a signal to noise ratio of the first speech signal; determines, according to the signal to noise ratio of the first speech signal, a fusion coefficient of filtered signals corresponding to the first speech signal and the second speech signal; and performs, according to the fusion coefficient, speech fusion processing on the filtered signals corresponding to the first speech signal and the second speech signal to obtain an enhanced speech signal. Thereby, it is realized that a fusion coefficient of speech signals of a non-air conduction speech sensor and an air conduction speech sensor is adaptively adjusted according to environment noise, thereby improving the signal quality after speech fusion, and improving the effect of speech enhancement.

Figure 6:
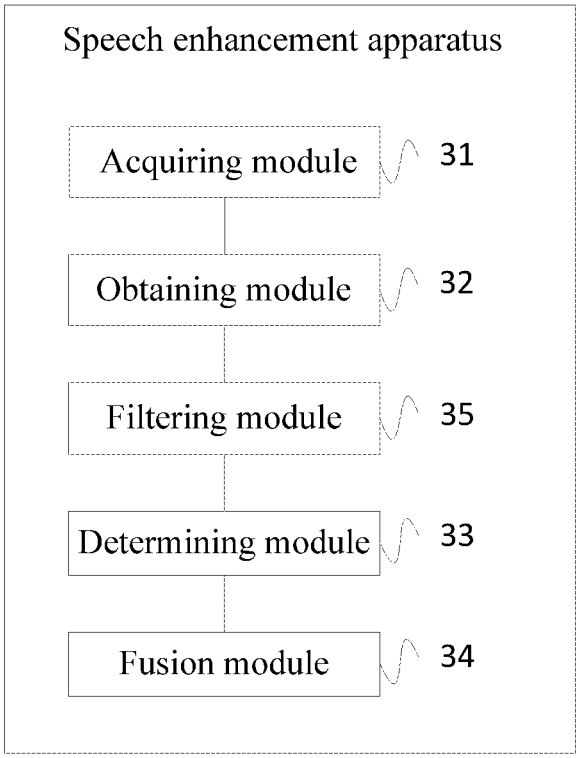
FIG. 6 is a schematic structural diagram of a speech enhancement apparatus according to Embodiment 4 of the present disclosure.

FIG. 6 is a schematic structural diagram of a speech enhancement apparatus according to Embodiment 4 of the present disclosure. As shown in FIG. 6, on the basis of the apparatus shown in FIG. 5, the speech enhancement apparatus of the embodiment may further include:

a filtering module 35, configured to determine, according to the signal to noise ratio of the first speech signal, a cutoff frequency of a first filter corresponding to the first speech signal, and a cutoff frequency of a second filter corresponding to the second speech signal;

perform filtering processing on the first speech signal through the first filter to obtain a first filtered signal, and performing filtering processing on the second speech signal through the second filter to obtain a second filtered signal.

Optionally, the filtering module 35 is specifically configured to:

obtain a priori signal to noise ratio of each frame of speech of the first speech signal;

determine, in a preset frequency range, a number of frequency points at which the priori signal to noise ratio continuously increases;

calculate and obtain the cutoff frequencies of the first filter and the second filter according to the number of frequency points, a sampling frequency of the first speech signal, and a number of sampling points of Fourier transform.

The speech enhancement apparatus of the embodiment can perform the technical solutions in the methods shown in FIG. 2 and FIG. 3. For the specific implementation process and technical principles, refer to related descriptions in the methods shown in FIG. 2 and FIG. 3, and details are not described herein again.

The embodiment acquires a first speech signal and a second speech signal; obtains a signal to noise ratio of the first speech signal; determines, according to the signal to noise ratio of the first speech signal, a fusion coefficient of filtered signals corresponding to the first speech signal and the second speech signal; and performs, according to the fusion coefficient, speech fusion processing on the filtered signals corresponding to the first speech signal and the second speech signal to obtain an enhanced speech signal. Thereby, it is realized that a fusion coefficient of speech signals of a non-air conduction speech sensor and an air conduction speech sensor is adaptively adjusted according to environment noise, thereby improving the signal quality after speech fusion, and improving the effect of speech enhancement.

In addition, the embodiment can further determine, according to the signal to noise ratio of the first speech signal, a cutoff frequency of a first filter corresponding to the first speech signal and a cutoff frequency of a second filter corresponding to the second speech signal; perform filtering processing on the first speech signal through the first filter to obtain a first filtered signal, and perform filtering processing on the second speech signal through the second filter to obtain a second filtered signal. Thereby the signal quality after speech fusion is improved, and the effect of speech enhancement is improved.

Figure 7:
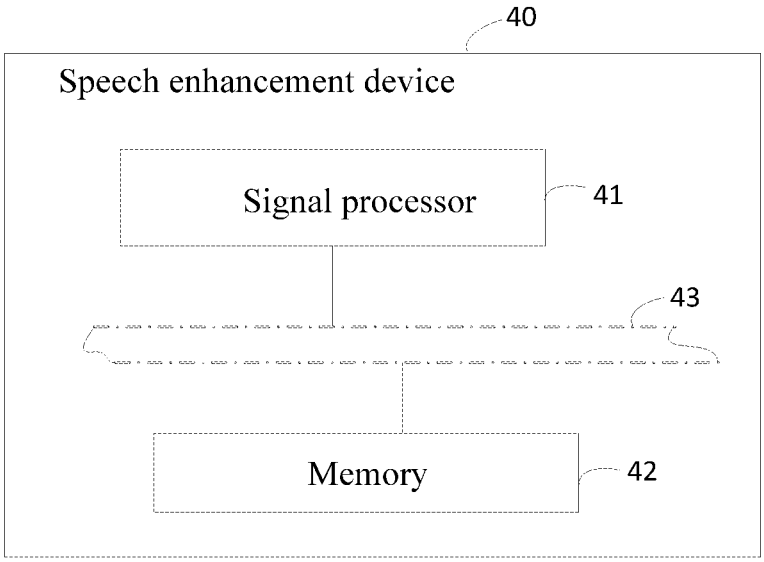
FIG. 7 is a schematic structural diagram of a speech enhancement device according to Embodiment 5 of the present disclosure.

FIG. 7 is a schematic structural diagram of a speech enhancement device according to Embodiment 5 of the present disclosure. As shown in FIG. 7, the speech enhancement device 40 of the embodiment includes:

a signal processor 41 and a memory 42; where:

the memory 42 is configured to store executable instructions, and the memory may also be flash (flash memory).

The signal processor 41 is configured to execute the executable instructions stored in the memory to implement various steps in the method involved in the above embodiments.

For details, refer to the related descriptions in the foregoing method embodiments.

Optionally, the memory 42 may be either stand-alone or integrated with the signal processor 41.

When the memory 42 is a device independent of the signal processor 41, the speech enhancement device 40 may further include:

a bus 43, configured to connect the memory 42 and the signal processor 41.

The speech enhancement device in the embodiment can perform the methods shown in FIG. 2 and FIG. 3. For the specific implementation process and technical principles, refer to related descriptions in the methods shown in FIG. 2 and FIG. 3, and details are not described herein again.

In addition, the embodiment of the present application further provides a computer readable storage medium, where computer execution instructions are stored therein, and when at least one signal processor of a user equipment executes the computer execution instructions, the user equipment performs the foregoing various possible methods.

The computer readable storage medium includes a computer storage medium and a communication medium, where the communication medium includes any medium that facilitates the transfer of a computer program from one location to another. The storage medium may be any available medium that can be accessed by a general purpose or special purpose computer. An exemplary storage medium is coupled to a processor, such that the processor can read information from the storage medium and can write information to the storage medium. Of course, the storage medium may also be a part of the processor. The processor and the storage medium may be located in an application specific integrated circuit (ASIC). In additional, the application specific integrated circuit can be located in a user equipment. Of course, the processor and the storage medium may also reside as discrete components in a communication device.

Those skilled in the art will understand that all or part of the steps to implement the various method embodiments described above may be accomplished by hardware related to program instructions. The aforementioned program may be stored in a computer readable storage medium. The program, when executed, performs the steps included in the foregoing various method embodiments; and the foregoing storage medium includes various media that can store program codes, such as a ROM, a RAM, a magnetic disk, or an optical disk.

Other embodiments of the present disclosure will be apparent to those skilled in the art after considering the specification and practicing the disclosure disclosed here. The present disclosure is intended to cover any variations, uses, or adaptive changes of the present disclosure, which are in accordance with the general principles of the present disclosure and include common general knowledge or conventional technical means in the art that are not disclosed in the present disclosure. The specification and embodiments are deemed to be exemplary only and the true scope and spirit of the present disclosure is indicated by the claims below.

It should be understood that the present disclosure is not limited to the precise structures described above and shown in the accompanying drawings, and can be subject to various modifications and changes without deviating from its scope. The scope of the present disclosure is limited only by the attached claims.

What is claimed is:

1. A speech enhancement method, comprising: acquiring a first speech signal and a second speech signal; obtaining a signal to noise ratio of the first speech signal; determining, according to the signal to noise ratio of the first speech signal, a fusion coefficient of filtered signals corresponding to the first speech signal and the second speech signal; and performing, according to the fusion coefficient, speech fusion processing on the filtered signals corresponding to the first speech signal and the second speech signal to obtain an enhanced speech signal; wherein determining, according to the signal to noise ratio of the first speech signal, a fusion coefficient of filtered signals corresponding to the first speech signal and the second speech signal comprises: constructing a solution model of the fusion coefficient, wherein the solution model of the fusion coefficient is as follows:

$$k_\lambda=\gamma k_{\lambda-1}+(1-\gamma)f(SNR),$$

wherein: $f(SNR)=0.5\cdot\tanh(0.025\cdot SNR)+0.5$, $$k_\lambda=\max[0,f(SNR)] \text{ or } k_\lambda=\min[f(SNR),1],$$

wherein, $k_\lambda$, is the fusion coefficient of a $\lambda^{th}$ frame of speech signal, $\gamma$ is a smoothing factor of the fusion coefficient, $k_{\lambda-1}$ is the fusion coefficient of a $(\lambda-1)$th frame of speech signal, and f(SNR) is a mapping function between a given signal to noise ratio SNR and the fusion coefficient $k_\lambda$; and wherein performing, according tot eh fusion coefficient, speech fusion processing on the filtered signals corresponding to the first speech signal and the second speech signal to obtain an enhanced speech signal comprises: performing speech fusion processing on the filtered signals corresponding to the first speech signal and the second speech signal by using a preset speech fusion algorithm; wherein a calculation formula of the preset speech fusion algorithm is as follows: $s=s_{bc}+k\cdot s_{ac}$, wherein: s is the enhanced speech signal after the speech fusion, $s_{ac}$, is the filtered signal corresponding to the first speech signal, $s_{bc}$ is the filtered signal corresponding to the second speech signal, and k is the fusion coefficient.

2. The method according to claim 1, wherein acquiring a first speech signal and a second speech signal comprises:

acquiring the first speech signal through an air conduction speech sensor, and acquiring the second speech signal through a non-air conduction speech sensor; wherein the non-air conduction speech sensor comprises a bone conduction speech sensor, and the air conduction speech sensor comprises a microphone.

3. The method according to claim 1, wherein obtaining a signal to noise ratio of the first speech signal comprises:

preprocessing the first speech signal to obtain a preprocessed signal;

performing Fourier transform processing on the preprocessed signal to obtain a corresponding frequency domain signal; and estimating a noise power of the frequency domain signal, and obtaining the signal to noise ratio of the first speech signal based on the noise power.

4. The method according to claim 3, wherein after obtaining a signal to noise ratio of the first speech signal, the method further comprises:

determining, according to the signal to noise ratio of the first speech signal, a cutoff frequency of a first filter corresponding to the first speech signal, and a cutoff frequency of a second filter corresponding to the second speech signal; and performing filtering processing on the first speech signal through the first filter to obtain a first filtered signal, and performing filtering processing on the second speech signal through the second filter to obtain a second filtered signal.

5. The method according to claim 4, wherein determining, according to the signal to noise ratio of the first speech signal, a cutoff frequency of a first filter corresponding to the first speech signal, and a cutoff frequency of a second filter corresponding to the second speech signal comprises:

obtaining a priori signal to noise ratio of each frame of speech of the first speech signal;

determining, in a preset frequency range, a number of frequency points at which the priori signal to noise ratio continuously increases; and calculating and obtaining the cutoff frequencies of the first filter and the second filter according to the number of frequency points, a sampling frequency of the first speech signal, and a number of sampling points of the Fourier transform.

6. The method according to claim 4, wherein determining, according to the signal to noise ratio of the first speech signal, a cutoff frequency of a first filter corresponding to the first speech signal, and a cutoff frequency of a second filter corresponding to the second speech signal comprises:

obtaining a priori signal to noise ratio of each frame of speech of the first speech signal;

selecting, in a low frequency part of the priori signal to noise ratio, a number of frequency points at which a slope of the priori signal to noise ratio continuously increases; and calculating and obtaining the cutoff frequencies of the first filter and the second filter according to the number of frequency points, a sampling frequency of the first speech signal, and a number of sampling points of the Fourier transform.

7. The method according to claim 4, wherein the first filter is a high pass filter and the second filter is a low pass filter.

8. A speech enhancement device, comprising: a signal processor and a memory; wherein the memory has an algorithm program stored therein, and the signal processor is configured to call the algorithm program in the memory to: acquire a first speech signal and a second speech signal; obtain a signal to noise ratio of the first speech signal; determine, according to the signal to noise ratio of the first speech signal, a fusion coefficient of filtered signals corresponding to the first speech signal and the second speech signal; and perform, according to the fusion coefficient, speech fusion processing on the filtered signals corresponding to the first speech signal and the second speech signal to obtain an enhanced speech signal; wherein the signal processor is configured to call the algorithm program in the memory to construct a solution model of the fusion coefficient, wherein the solution model of the fusion coefficient is as follows:

$$k_\lambda=\gamma_{k\lambda 1}+(1-\gamma)f(SNR),$$

wherein: $f(SNR)=0.5\cdot\tanh(0.025\cdot SNR)+0.5$, $$k_\lambda=\max[0,f(SNR)] \text{ or } k_\lambda=\min[f(SNR),1],$$

wherein: $k_\lambda$, is the fusion coefficient of a $\lambda^{th}$ frame of speech signal, $\gamma$ is a smoothing factor of the fusion coefficient, $k_{\lambda-1}$ is the fusion coefficient of a $(\lambda-1)$ frame of speech signal, and f(SNR) is a mapping function between a given signal to noise ratio SNR and the fusion coefficient $k_\lambda$; and wherein the signal processor is configured to call the algorithm program in the memory further to: perform speech fusion processing on the filtered signals corresponding to the first speech signal and the second speech signal by using a preset speech fusion algorithm; wherein a calculation formula of the preset speech fusion algorithm is as follows: $s=s_{bc}+k\cdot s_{ac}$, wherein: s is the enhancement speech signal after the speech fusion, $s_{ac}$ is the filtered signal corresponding to the first speech signal, $s_{bc}$ is the filtered signal corresponding tot he second speech signal, and k is the fusion coefficient.

9. The device according to claim 8, wherein the signal processor is configured to call the algorithm program in the memory further to:

acquire the first speech signal through an air conduction speech sensor, and acquire the second speech signal through a non-air conduction speech sensor; wherein the non-air conduction speech sensor comprises a bone conduction speech sensor, and the air conduction speech sensor comprises a microphone.

10. The device according to claim 8, wherein the signal processor is configured to call the algorithm program in the memory further to:

preprocess the first speech signal to obtain a preprocessed signal;

perform Fourier transform processing on the preprocessed signal to obtain a corresponding frequency domain signal; and estimate a noise power of the frequency domain signal, and obtain the signal to noise ratio of the first speech signal based on the noise power.

11. The device according to claim 10, wherein the signal processor is configured to call the algorithm program in the memory further to:

determine, according to the signal to noise ratio of the first speech signal, a cutoff frequency of a first filter corresponding to the first speech signal, and a cutoff frequency of a second filter corresponding to the second speech signal; and perform filtering processing on the first speech signal through the first filter to obtain a first filtered signal, and perform filtering processing on the second speech signal through the second filter to obtain a second filtered signal.

12. The device according to claim 11, wherein the signal processor is configured to call the algorithm program in the memory further to:

obtain a priori signal to noise ratio of each frame of speech of the first speech signal;

determine, in a preset frequency range, a number of frequency points at which the priori signal to noise ratio continuously increases; and calculate and obtain the cutoff frequencies of the first filter and the second filter according to the number of frequency points, a sampling frequency of the first speech signal, and a number of sampling points of the Fourier transform.

13. The device according to claim 11, wherein the signal processor is configured to call the algorithm program in the memory further to:

obtain a priori signal to noise ratio of each frame of speech of the first speech signal;

select, in a low frequency part of the priori signal to noise ratio, a number of frequency points at which a slope of the priori signal to noise ratio continuously increases; and calculate and obtain the cutoff frequencies of the first filter and the second filter according to the number of frequency points, a sampling frequency of the first speech signal, and a number of sampling points of the Fourier transform.

14. The device according to claim 11, wherein the first filter is a high pass filter and the second filter is a low pass filter.

15. The device according to claim 8, wherein the device is an earphone.

16. A non-transitory computer readable storage medium, comprising: program instructions, which, when running on a computer, cause the computer to execute the program instructions to implement the speech enhancement method of claim 1.

* * * * *